US006796095B2

(12) United States Patent
Azar et al.

(10) Patent No.: US 6,796,095 B2
(45) Date of Patent: Sep. 28, 2004

(54) TILE MOUNTING STRIP

(76) Inventors: Sammy Azar, 13954 Bournemuth, Shelby Township, MI (US) 48315; Joseph Albo, 18285 Ranier, Macomb Township, MI (US) 48042

( * ) Notice: Subject to any disclaimer, the term of this patent is extended or adjusted under 35 U.S.C. 154(b) by 9 days.

(21) Appl. No.: 10/218,821

(22) Filed: Aug. 14, 2002

(65) Prior Publication Data

US 2004/0031232 A1 Feb. 19, 2004

(51) Int. Cl.[7] ..... E04B 2/00

(52) U.S. Cl. ..... 52/371; 52/747.11; 52/366; 52/389

(58) Field of Search ..... 52/371, 364, 366, 52/747.11, 385, 387, 389, 384, 717.06; 156/71

(56) References Cited

U.S. PATENT DOCUMENTS

| | | | | |
|---|---|---|---|---|
| 2,872,804 A | | 2/1959 | Baldanza | |
| 3,953,268 A | * | 4/1976 | Dillon | 156/71 |
| 4,450,664 A | | 5/1984 | McNamee | 52/385 |
| 5,423,154 A | * | 6/1995 | Maylon et al. | 52/371 |
| 6,338,229 B1 | * | 1/2002 | Botzen | 52/371 |
| 6,374,563 B1 | | 4/2002 | Erskine et al. | 52/506 |

FOREIGN PATENT DOCUMENTS

| | | | | |
|---|---|---|---|---|
| GB | 2106558 | * | 4/1983 | 52/371 |

* cited by examiner

*Primary Examiner*—Carl D. Friedman
*Assistant Examiner*—Naoko Slack
(74) *Attorney, Agent, or Firm*—Dinnin & Dunn, P.C.

(57) ABSTRACT

An elongate tile mounting strip that includes a center body with two extension edges, the extension edges being oriented substantially perpendicular to one another and positioned at opposite corners of the body. A first of the extension edges and a substantially perpendicular mud face of the body define a first ledge, and a second of the extension edges and a substantially perpendicular tile face of the body define a second ledge. The tile face is a reference surface for positioning a layer of adherent material along the first ledge in a predetermined thickness, the thickness being equal to a width of the mud face, and an inner surface of the second extension edge is a locating surface for aligning a plurality of tiles longitudinally therealong.

11 Claims, 1 Drawing Sheet

TILE MOUNTING STRIP

TECHNICAL FIELD

The present invention relates generally to tools for mounting and positioning tile facing, and more particularly to such a tool that includes a strip having a plurality of ledges for positioning tiles and tile cement thereon.

BACKGROUND OF THE INVENTION

Installation of tile floors and walls has long been a painstaking, expensive process. While various methods of installing and aligning tile have developed over many years, improvements in speed and efficiency are always welcomed by the industry. One traditional method of installing tile favored by professionals begins by temporarily affixing a wooden slat or board to the wall upon which a tiled surface is desired. For example, an installer nails an elongate wooden slat upright on a wall. The wall surface may be any suitable backing, such as a traditional metallic mesh or lathe strung between the wall studs, cinder/concrete blocks, "green board," etc. The installer next fills the entire wall surface, bounded laterally by the slat, with cement or mud. The installer then places a second slat at the opposite end of the work surface, parallel to the first slat. Once in place, a long flattened tool (for instance, a third slat, metal strip, or trowel) is placed across the gap between the upright slats, then pulled downward while kept in contact with both slats, scraping away excess mud to leave a relatively flat surface to which the tiles may be affixed. Finally, the slats are pulled from the wall. When the slats are pulled from the wall, a rough edge remains at the edge of the mud surface, or a gap where the mud-covered surface continues laterally beyond where the slat was placed.

Gaps can be filled with mud, however, an old problem plaguing tile installers has been how to appropriately finish the tile surface where a rough edge of mud remains after the slats are removed. One approach has been to incorporate tile pieces having a rounded edge that extends around the edge of the mud to rest against the wall underlying the mud layer. This method has been popular, however, there are significant drawbacks. The rounded pieces of tile, known as "bullnose" tile, tend to be expensive, and are unavailable in many less-popular tile styles. Moreover, when accompanying the traditional mud application method outlined above, the use of bullnose tile is very time consuming. In a second approach, the installer cuts thin pieces of tile, slivers, to place in the gap, and positions the slivers at approximately 90° relative to the tiled surface, where they can extend to the wall underlying the mud layer. While the installer is not limited to styles provided by the manufacturer, since he cuts the slivers from the same stock used for the tile surface, a tremendous drawback to this approach is the time and expense required to fashion the slivers of tile with the necessary wet saw. The present invention is directed to one or more of the problems and shortcomings associated with the related art.

SUMMARY OF THE INVENTION

In one aspect, an alignment strip for tile is provided that includes an elongate strip member having a body with two extension edges. The extension edges are oriented substantially perpendicular to one another and positioned at opposite corners of the body. A first of the extension edges and a substantially perpendicular mud face of the body define a first ledge, and a second of the extension edges and a substantially perpendicular tile face of the body define a second ledge. The tile face has a layer of adherent material along the first ledge in a predetermined thickness, the thickness equal to a width of the mud face. An inner surface of the second extension edge aligns a plurality of tiles longitudinally along the second ledge.

In another aspect, a method of forming a tiled surface is provided. The method includes the steps of affixing a positioning strip to a structure, the positioning strip defining substantially right-angular first and second open channels, the channels sharing a common central edge, and applying a rough layer of adherent material to the structure, a portion of the layer filling the first channel. The method further includes the steps of positioning a blade in the second channel and passing the blade longitudinally along the second channel while maintained flush with a side of the second channel. Passing of the blade removes adherent material from the rough layer to leave a substantially uniformly thick finished layer in the first channel, a thickness of the finished layer defined by a width of a wall of the first channel. Finally the method includes the step of aligning a plurality of tiles along the second channel, edges of the tiles positioned substantially parallel an inside wall of the second channel, and a back of each tile contacting a portion of the finished layer.

DETAILED DESCRIPTION

Figure 1:
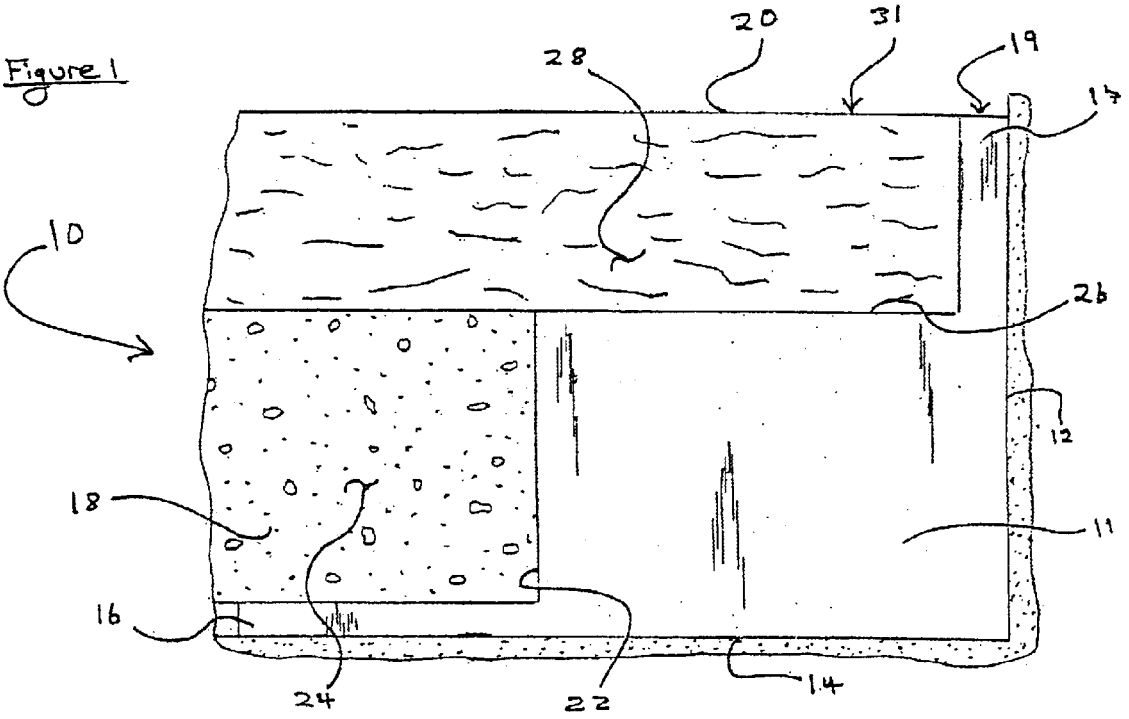
FIG. 1 is a sectioned side view of a tile mounting strip according to a preferred embodiment of the present invention.
Figure 2:
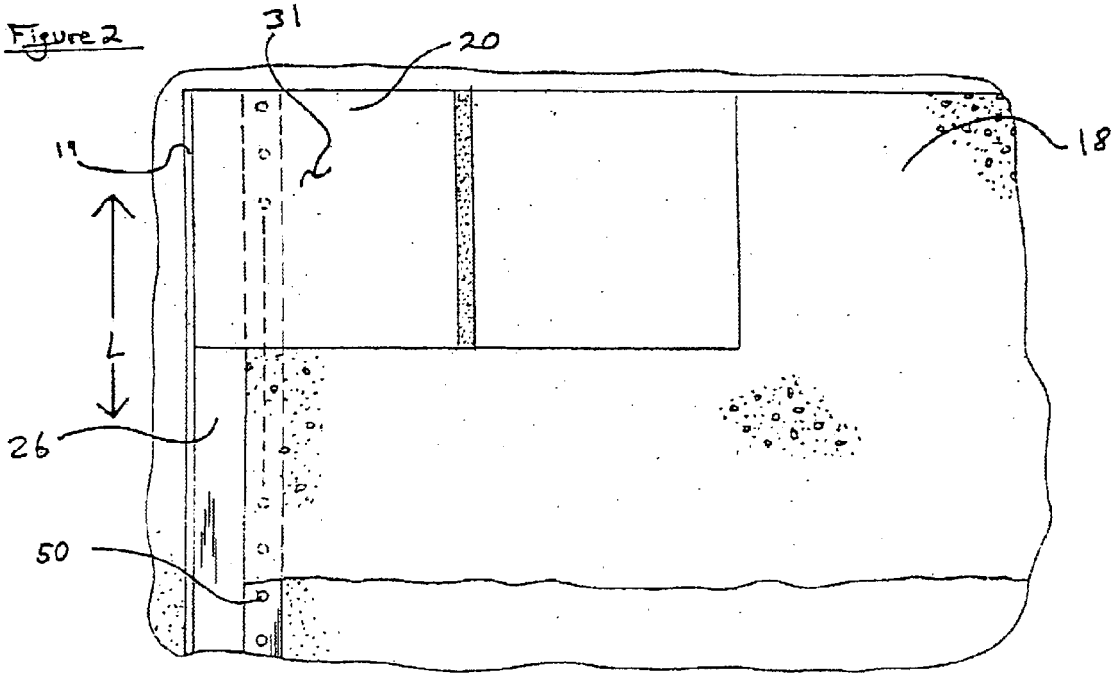
FIG. 2 is a partial front view of the tile mounting strip of FIG. 1, shown fastened to a wall and having tile panels secured thereto.

Referring to FIGS. 1 and 2, there is illustrated a tile mounting strip 10 according to a preferred embodiment of the present invention. Strip 10 is an elongate, preferably metallic member that facilitates mounting of tile and tiling cement to a floor or wall. In particular, strip 10 allows a tile installer to easily apply a relatively uniform layer of tiling cement to a floor or wall, and assists the installer in properly positioning tile on the cement surface. In addition, the present invention serves as a convenient, aesthetically pleasing means for forming a transition between a tile surface and plaster, drywall, or some other surface. In a preferred embodiment, strip 10 is affixed to a building structure, e.g. a wall, floor, or even a ceiling, with conventional fasteners, e.g. nails or screws, which may be driven through a plurality of longitudinally spaced holes 50, aligned along the length of strip 10. It should be appreciated, however, that strip 10 might be affixed to the building structure with any of a variety of known adhesives rather than with fasteners. In one contemplated alternative embodiment, strip 10 includes a plurality of integral fasteners projecting from its back, and the entire piece can be hammered to the wall. Strip 10 may be formed by any of a variety of manufacturing methods. For instance, the strip may be machined from a single block, die cast, or formed from a plurality of separate members fastened together. Although aluminum is preferred, strip 10 might be formed from a variety of other materials including but not limited to other suitable metals, polyvinyl chloride (PVC), other plastics, ceramics, or even wood.

Strip 10 includes a body 11, which is preferably substantially rectangular, and a first and second extension edge or flange 16, 17, respectively. It should be understood that as used herein, the term "extension edge" refers to the entirety of each of the two protrusions extending from body 11. First extension edge 16 and a mud face or first inner face 22 of body 11 define a first channel or ledge 24 extending longitudinally along a length L of strip 10. Second extension edge 17 and a tile face or second inner face 26 of body 11 define a second channel or second ledge 28 extending longitudinally along the length L of strip 10. Both first and second channels or ledges 24 and 28 are preferably substantially right angular. First and second extension edges 16 and 17 are preferably substantially rectangular, however, they might be tapered toward their ends if desired. First extension edge 16 is preferably longer than second extension edge 17, however, an alternative embodiment is contemplated in which extension edges 16 and 17 are substantially equal in length, and center body 11 is substantially square. In this embodiment, strip 10 is substantially symmetrical about a plane lying equidistant, i.e. about 45°, from both side surface 12 and rear surface 14.

In a preferred embodiment, conventional mud or tile cement 18 is preferably positioned in first channel 24, while a plurality of tile pieces 20 are placed in second channel 28. Those skilled in the art will appreciate that preformed sheets of cement or mud, widely available and known in the art, may be substituted for the traditional formable mud described with respect to the present invention. A preferred installation of a tile system incorporating the present invention begins by securing strip 10 to the wall or floor such that a length of the strip L is oriented in a direction parallel to the desired orientation of the conventional square tiles. Strip 10 may be used in attaching tile to a wide variety of surface, including but not limited to traditional lathe, drywall, concrete or cinder blocks, etc. Next, a layer of cement or mud 18 is placed on the wall or floor, with an edge of the layer overlaying first extension edge 16. The mud may be initially applied to the wall in any suitable manner, however, the known conventional method of placing a rough layer of mud on the wall with a trowel is preferred. Once an initial layer of mud is placed on the wall, a scraping implement, preferably a tool with a flat blade or a strip of material with an elongate flat surface such as a wooden slat, is placed substantially flush against tile face 26, and pulled downward along the length L of strip 10. By keeping the flat surface of the blade/slat substantially flush with tile face 26 while pulling the blade/slat downward, mud can be carved away from the rough, initial layer to leave a relatively smooth, finished layer. In an embodiment utilizing preformed sheets of mud, the scraping step is unnecessary, and the sheet can be initially mounted with an edge in first channel 24. The layer of mud remaining after the scraping step will have a substantially uniform thickness, approximately equal to the width of surface 22. In a preferred embodiment, surface 22 ranges from about ½" to about 1", varying based upon the desired thickness of the mud layer, however, this range could be expanded from anywhere between about 1/16" to several inches. Because mud is applied on the work surface/wall beyond the area covered by strip 10, the thickness of the mud will be slightly greater in this area lateral of strip 10, to compensate for the thickness of extension edge 16, preferably about 1/16". Using strip 10, the worker can prepare a substantially flat mud work surface, using a blade to scrape away excess mud. In a preferred embodiment, the entire surface upon which the worker desires to place tile may be prepared in this manner, ranging up to over several meters wide, limited only by the length of the available scraping tool.

Tile face 26 is preferably about 1" wide, however, it is contemplated that strip 10 might be manufactured with a greater width to facilitate preparation of a relatively large mud surface. In such an embodiment, the increased width could provide a larger surface upon which the scraping tool could be braced while drawn downward to remove excess mud and prepare the finished surface. Where tiling of a particularly wide surface is desired, multiple strips similar to the present strip 10 can be employed, mounted at different points along the wall or floor. Thus, tile face 26 serves as a locating or reference surface for proper positioning of the mud removal tool, facilitating proper preparation of the finished mud layer.

Once the wall is prepared in accordance with the step above, the next undertaking involves placing the tile onto strip 10. Second extension edge 17 serves as a lateral locating surface for properly positioning tile. Thus, the worker can begin by placing a first tile in second channel 28 such that the tile's back surface is flush with surface 26, and an edge of the tile is positioned flush against second extension edge 17. If desired, the worker could place a layer of grout between second extension edge 17 and the edge of the tile. The tiles are preferably placed longitudinally along second channel 28, allowing a majority of the tile's back surface to contact the mud surface 18, to which the tiles preferably adhere upon contact. An optional step involves preparing surface 26 prior to placing the tiles thereon, by covering it with an adhesive; however, ordinarily the contact of the mud surface 18 with the tile is sufficient to hold the tile in the appropriate position. In a preferred embodiment, second extension edge 17 has an end face 19 about 1/16" in diameter, that is substantially aligned with the outer surface of the tile 31 when installed with strip 10. Second extension edge 17 preferably has a length ranging from about ¼" to about 1", corresponding to the thickness of the tile preferably mounted with strip 10, as illustrated in FIG. 1, however, the range might be larger for non-conventional sized tiles. Various different embodiments are contemplated, in which second extension edge 17 is sized according to the particular tile used. In one embodiment, first and second extension edges 16 and 17 are substantially equal in dimension, and body 11 is substantially square, making strip 10 symmetrical about a line passing diagonally through body 11, and located approximately 45° from a side surface 12 of body 11, and a rear surface 14. In this embodiment, strip 10 may be positioned with either of its two exterior surfaces, i.e. those surfaces not co-extensive with channels 24 and 18, against the building structure. In a preferred embodiment, the side surface 12 of strip 10 abuts a piece of drywall, wood, wood paneling, or some other interior finishing surface. It should be appreciated, however, that in an embodiment utilizing multiple strips 10, another system of tile and mud could abut directly against side surface 12.

The present description is for illustrative purposes only, and should not be construed to limit the breadth of the present invention in any way. Thus, those skilled in the art will appreciate that various modifications might be made to the presently disclosed embodiments without departing from the intended spirit and scope of the present invention. Other aspects, features, and advantages will be apparent upon examination of the drawing figures and appended claims.

What is claimed is:

1. An alignment strip for tile comprising:

an elongate strip member having a body with first and second extension edges, said extension edges oriented substantially perpendicular to one another and positioned at opposite corners of said body, said body having a planar side face and a planar rear face oriented substantially perpendicular said side face;

said rear face partially coextensive with said first extension edge;

said side face partially coextensive with said second extension edge, said side face and said rear face defining a substantially square corner and intersecting at a common edge;

said first extension edge and a substantially perpendicular mud face of said body defining a first ledge;

said second extension edge and a substantially perpendicular tile face of said body defining a second ledge;

said tile face having a layer of adherent material along said first ledge in a predetermined thickness, said thickness equal to a width of said mud face;

an inner surface of said second extension edge aligns a plurality of tiles longitudinally along said second ledge.

2. The strip according to claim 1 wherein said second extension edge has an end face substantially parallel to said tile face, and a length of said second extension edge is such that said end face is aligned with an exterior face of tiles adhered to said layer of adherent material on said first ledge.

3. The strip according to claim 1 wherein said second extension edge has a length in the range of about ¼" to about 1".

4. The strip of claim 1 wherein said strip is formed from a central solid block portion with first and second flange portions attached to said central solid block portion.

5. The strip of claim 1 wherein said strip is machined from a unitary block.

6. The strip of claim 1 wherein said strip is metallic.

7. The strip of claim 1 wherein said first extension edge defines a plurality of holes.

8. The strip of claim 1 wherein said first extension edge is longer than said second extension edge.

9. The strip of claim 1 wherein said strip is symmetrical about an axis substantially equidistant between said rear face and said side face.

10. A method of forming a tiled surface comprising the steps of:

affixing a positioning strip to a structure, the positioning strip defining substantially right-angular first and second open channels, the channels sharing a common central edge; said strip having substantially perpendicular planar rear and side surfaces with a common edge, wherein said rear and side surfaces are partially coextensive with first and second extension edges, respectively;

applying a rough layer of adherent material to the structure, a portion of the layer filling the first channel;

positioning a blade in the second channel and passing the blade longitudinally along the second channel while maintained flush with a side of the second channel, passing of the blade thereby removing adherent material from the rough layer to leave a substantially uniformly thick finished layer in the first channel, a thickness of the finished layer defined by a width of a wall of the first channel; and aligning a plurality of tiles along the second channel, edges of the tiles positioned substantially parallel an inside wall of the second channel, and a back of each tile contacting a portion of the finished layer.

11. The method of claim 10 further comprising the step of:

positioning a layer of adhesive along a surface of the second channel prior to positioning the tiles thereon.

* * * * *